US010234222B2

(12) United States Patent
Couce

(10) Patent No.: US 10,234,222 B2
(45) Date of Patent: Mar. 19, 2019

(54) SINGLE 40 MM PROJECTILE LAUNCHER

(71) Applicant: Gonzalo Couce, Grimsby (CA)

(72) Inventor: Gonzalo Couce, Grimsby (CA)

( * ) Notice: Subject to any disclaimer, the term of this patent is extended or adjusted under 35 U.S.C. 154(b) by 0 days.

(21) Appl. No.: 15/672,900

(22) Filed: Aug. 9, 2017

(65) Prior Publication Data

US 2018/0045478 A1 Feb. 15, 2018

Related U.S. Application Data

(60) Provisional application No. 62/372,510, filed on Aug. 9, 2016.

(51) Int. Cl.
*F41A 15/06* (2006.01)
*F41A 3/58* (2006.01)
*F41A 19/54* (2006.01)

(52) U.S. Cl.
CPC ..... *F41A 15/06* (2013.01); *F41A 3/58* (2013.01); *F41A 19/54* (2013.01)

(58) Field of Classification Search
CPC ..... F41A 15/06; F41A 19/54; F41A 3/58
USPC ..... 42/2, 8
See application file for complete search history.

(56) References Cited

U.S. PATENT DOCUMENTS 1,530,041 A * 3/1925 Fearn ..... F41A 15/06 42/47
3,193,960 A * 7/1965 Stevens, Jr. ..... F41A 3/58 42/44
3,346,983 A * 10/1967 Brooks ..... F41A 15/06 42/47
3,507,067 A * 4/1970 Into ..... F41A 19/40 42/10
3,557,482 A * 1/1971 Hoover ..... F41C 27/06 42/1.07
3,641,691 A * 2/1972 Ellis ..... F41C 27/06 42/105
3,722,358 A * 3/1973 Seecamp ..... F41A 19/48 89/147
3,967,402 A * 7/1976 Cooksey ..... F41A 3/58 42/10

(Continued)

OTHER PUBLICATIONS

Dan Alex, Defcom XL79 Composite, Jun. 19, 2013, https://www.militaryfactory.com/smallarms/detail.asp?smallarms_id=739, pp. 1-3 (Year: 2013).*

*Primary Examiner* — Joshua E Freeman
*Assistant Examiner* — Bridget A Cochran
(74) *Attorney, Agent, or Firm* — Robert M. Downey, P.A.

(57) ABSTRACT

A launcher device for launching a 40 mm projectile (i.e., both high explosive grenades and less lethal 40 mm rounds) includes a receiver assembly, a removable buttstock, a pivoting barrel assembly, a barrel stop that limits opening of the barrel to approximately 45 degrees relative to the receiver for fast reloading, and an auto ejection assembly for ejecting spent casings out of the chamber upon opening the barrel. Individual 40 mm rounds are loaded into the chamber at the proximal end of the barrel assembly by releasing a barrel stop lever assembly and pivoting the barrel assembly open relative to the receiver assembly. The launcher further includes a hidden double action trigger group which prevents accidental firing. An arrangement of built-in picatinny rails on the barrel allow for attachment of accessories such as lights, fore grips, slings, etc.

3 Claims, 6 Drawing Sheets

(56) References Cited

U.S. PATENT DOCUMENTS 3,984,933 A * 10/1976 Ruger ..... F41A 15/06 42/47
4,156,981 A * 6/1979 Lusk ..... F41A 9/27 42/105
4,267,764 A * 5/1981 Yaniger ..... F41A 17/64 42/106
4,680,884 A * 7/1987 Smith, Jr. ..... F41A 17/46 42/66
4,964,232 A * 10/1990 Mainland ..... F41A 3/58 42/44
4,967,501 A * 11/1990 Hunter ..... F41A 19/21 42/69.01
4,976,059 A * 12/1990 Marzocco ..... F41A 15/06 42/46
5,052,144 A * 10/1991 Ostor ..... F41A 9/25 42/105
5,235,771 A * 8/1993 Sokol ..... F41C 27/06 42/105
5,469,649 A * 11/1995 Rowlands ..... F41A 3/58 42/41
5,548,914 A * 8/1996 Anderson ..... F41A 17/82 42/65
5,680,722 A * 10/1997 French ..... F41A 3/58 42/20
6,397,505 B1 * 6/2002 Stratton ..... F41A 15/06 42/25
7,156,085 B2 * 1/2007 Lewis ..... F41B 11/646 124/63
7,257,918 B2 * 8/2007 Moore ..... F41A 19/48 42/69.03
7,316,092 B2 * 1/2008 DeLeeuw ..... F41A 3/58 42/40
7,328,530 B2 * 2/2008 Griffin ..... F41A 21/48 42/105
8,495,831 B1 * 7/2013 Kohout ..... F41C 3/00 42/42.03
8,997,390 B1 * 4/2015 Heizer ..... F41A 3/58 42/42.03
9,335,110 B1 * 5/2016 Heizer ..... F41A 19/29
9,500,424 B1 * 11/2016 Lodewyks ..... F41A 15/06
9,518,791 B1 * 12/2016 Heizer ..... F41A 19/29
2008/0120886 A1 * 5/2008 Ahlman ..... F41A 3/58 42/17
2008/0282596 A1 * 11/2008 DeLeeuw ..... F41A 3/58 42/51
2009/0044437 A1 * 2/2009 Zajk ..... F41A 19/10 42/65
2011/0072704 A1 * 3/2011 Teach, Jr. ..... F41A 3/58 42/8
2011/0167693 A1 * 7/2011 Gussalli Beretta ..... F41A 15/06 42/46
2012/0159829 A1 * 6/2012 Krutil ..... F41A 3/58 42/40
2013/0167419 A1 * 7/2013 Moretti ..... F41A 3/58 42/8
2014/0165441 A1 * 6/2014 Emde ..... F41C 3/00 42/8
2015/0253097 A1 * 9/2015 Kohout ..... F41A 19/21 42/8
2016/0153744 A1 * 6/2016 Teetzel ..... F41C 27/06 42/105

* cited by examiner

SINGLE 40 MM PROJECTILE LAUNCHER

This non-provisional patent application is based on provisional patent application Ser. No. 62/372,510 filed Aug. 9, 2016.

BACKGROUND OF THE INVENTION

Field of the Invention

The present invention relates to a single 40 mm projectile launcher and, more particularly, to a launcher device that is capable of launching both high explosive 40 mm grenades and less lethal 40 mm rounds, and wherein the launcher includes an automatic ejector system for ejecting casings of spent rounds.

Discussion of the Related Art

Single launcher devices are known and typically include a barrel and a trigger for releasing a firing pin that strikes the firing cap of a 40 mm round loaded in the launcher device. The various single 40 mm projectile launchers have various problems associated with them including the barrel becoming loose after multiple firings of projectiles. Other problems associated with existing single 40 mm launcher devices include trigger and hammer jams upon firing. Additionally, existing single 40 mm projectile launchers have problems associated with accuracy and ejecting spent rounds, as well as rust and corrosion.

Objects and Advantages of the Present Invention

The present invention proposes to provide a single 40 mm projectile launcher for both firing high explosive 40 mm grenades (i.e., HE Grenades) and less-lethal 40 mm rounds.

A further object of the present invention is to provide a single 40 mm projectile launcher that includes a 12.9 inch barrel for providing best in class accuracy.

Another object of the present invention is to provide a single 40 mm projectile launcher that includes a pivoting barrel assembly that opens to approximately 45 degrees relative to the receiver to allow for quick and efficient reloading.

It is a further object of the present invention to provide a single 40 mm projectile launcher that includes a special dovetail hinge point that prevents the barrel from getting loose or swaying left and right over time after multiple uses.

It is yet a further object of the present invention to provide a single 40 mm projectile launcher that includes a specially designed hidden double action trigger assembly which prevents the hammer spur from hanging up on operations.

It is still a further object of the present invention to provide a single 40 mm projectile launcher that includes an automatic casing ejector system.

It is yet a further object of the present invention to provide a single 40 mm projectile launcher that includes integrated picatinny rails on the barrel for attachment of various accessories such as, but not limited to, lights, fore grips, slings, etc.

It is still a further object of the present invention to provide a single 40 mm projectile launcher that includes a waterproof nitrate coating to make the launcher rustproof.

These and other objects and advantages of the present invention are more readily apparent with reference to the following description taken in conjunction with the accompanying drawings.

BRIEF DESCRIPTION OF THE DRAWINGS

For a fuller understanding of the nature of the present invention, reference should be made to the following description taken in conjunction with the accompanying drawings in which.

Like reference numerals refer to like parts throughout the several views of the drawings.

DESCRIPTION OF THE PREFERRED EMBODIMENT

Figure 1:
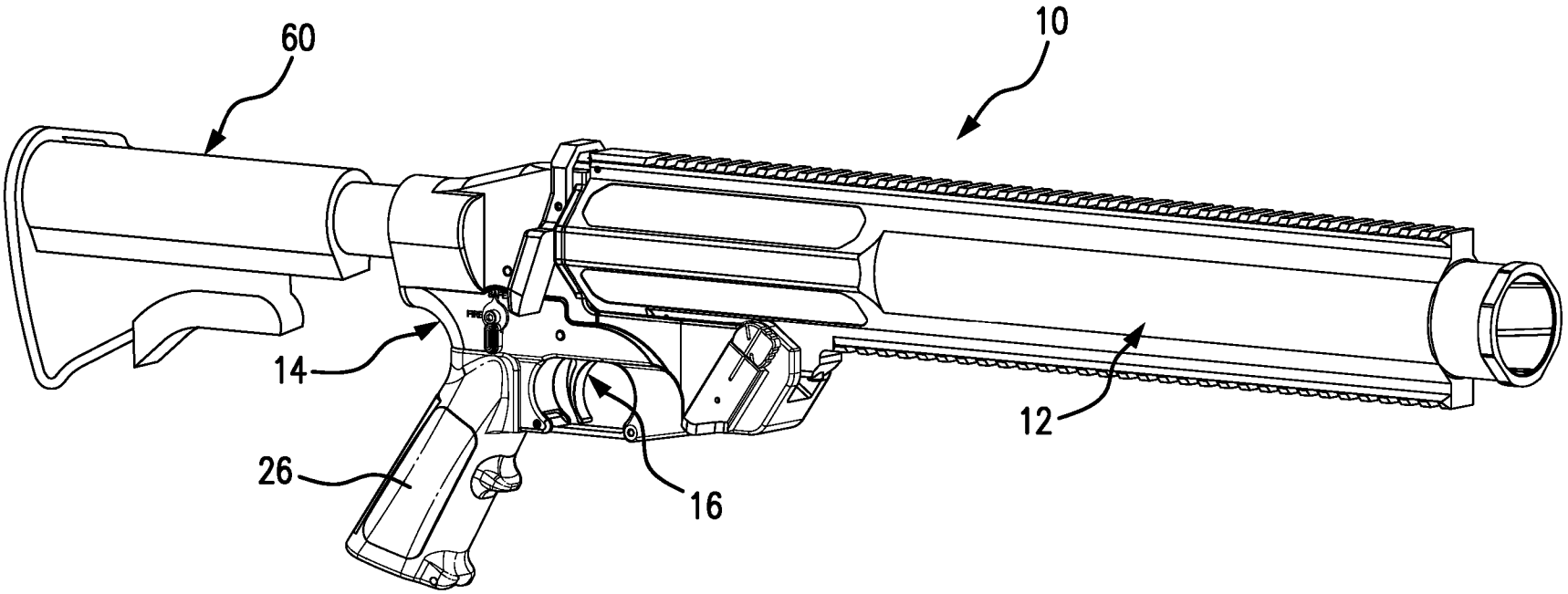
FIG. 1 is a front side perspective view of the single 40 mm projectile launcher of the present invention, in accordance with one preferred embodiment thereof.

A launcher device 10 for launching a 40 mm projectile is capable of firing both high explosive 40 mm grenades and less lethal 40 mm rounds. The single 40 mm projectile launcher includes a receiver assembly 14, a pivoting barrel assembly 12 and a dovetail mounting structure 18 on the receiver assembly 14 for pivotally attaching the barrel assembly 12 to the receiver assembly 14. The dovetail mounting structure helps to discourage swaying (i.e., left and right movement) of the barrel assembly 12 relative to the receiver assembly 14. A spring loaded takedown pin 22 with a cooperating ball and detent arrangement on the takedown pin 22 and dovetail structure 18 secures the barrel assembly 12 to the receiver assembly 14 and serves as a hinge system to allow pivoting movement of the barrel assembly between the cocked and loaded position (see FIGS. 1 and 2) and the open reload position (see FIGS. 3-5). The takedown pin 22 can be removed to allow separation of the barrel assembly 12 from the receiver 14. A barrel stop 24 on the dovetail structure 18 limits pivoting opening movement of the barrel assembly 12 to less than 70 degrees, and preferably to approximately 45 degrees relative to the receiver assembly 14. This allows for more efficient and faster ejection and reloading of rounds by preventing the barrel assembly from dropping all the way down to 90 degrees or more, as is typical in other launchers in the prior art. Individual 40 mm rounds are loaded into the chamber at the proximal end of the barrel assembly 12 by releasing a receiver latch 50 and pivoting the barrel assembly 12 open relative to the receiver assembly 14 to the 45 degree open position. The barrel assembly 12 is then hinged closed relative to the receiver assembly and locked closed by the receiver latch 50 for firing. Spent casings are ejected by an ejection assembly when pivoting the barrel assembly 12 open relative to the receiver assembly 14.

Figure 4:
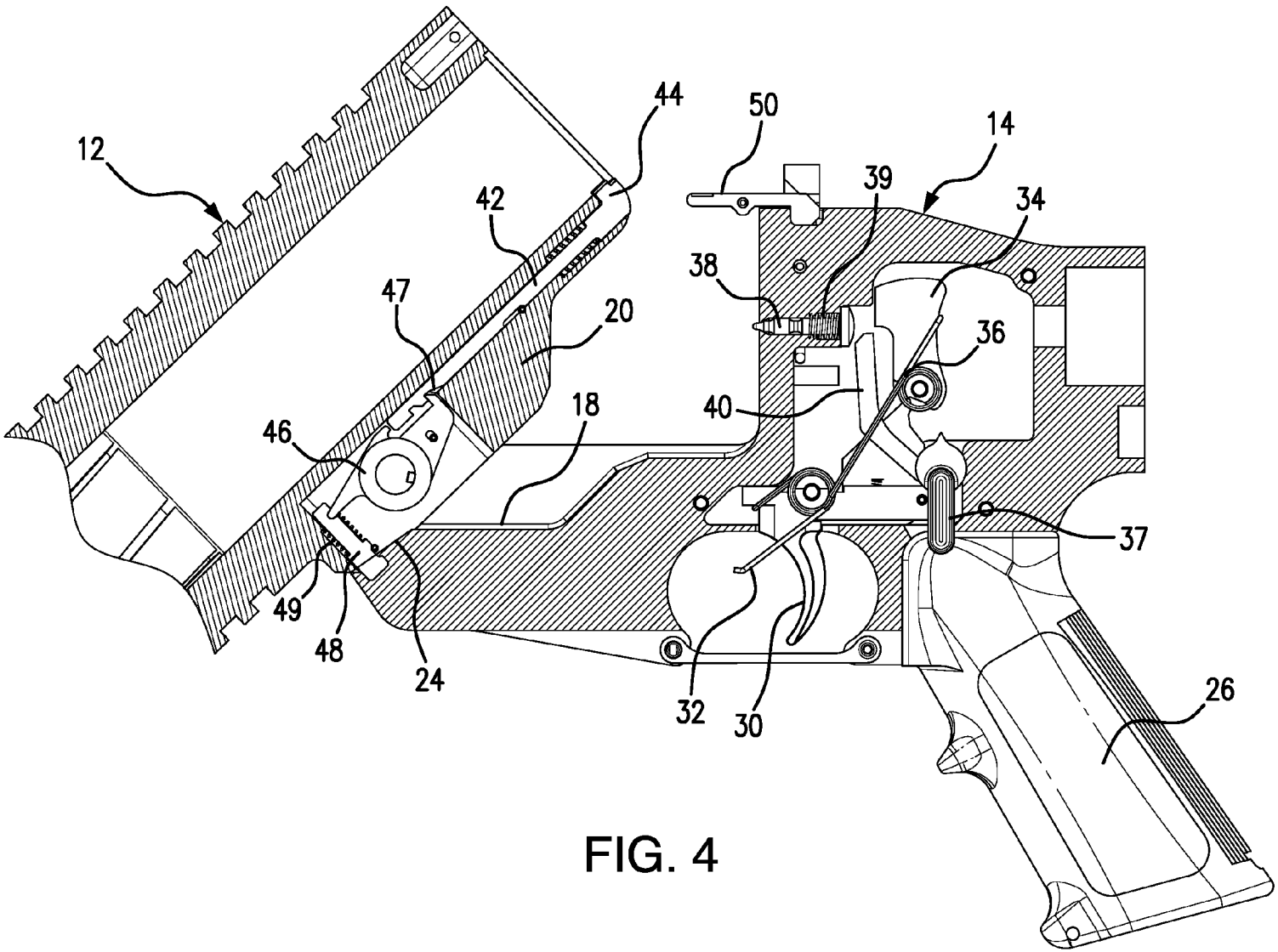
FIG. 4 is an isolated view, in partial cross section showing a double action trigger assembly in the receiver assembly and an automatic ejection assembly in the barrel assembly, with the barrel assembly opened to the 45 degree stop position relative to the receiver assembly.
Figure 5:
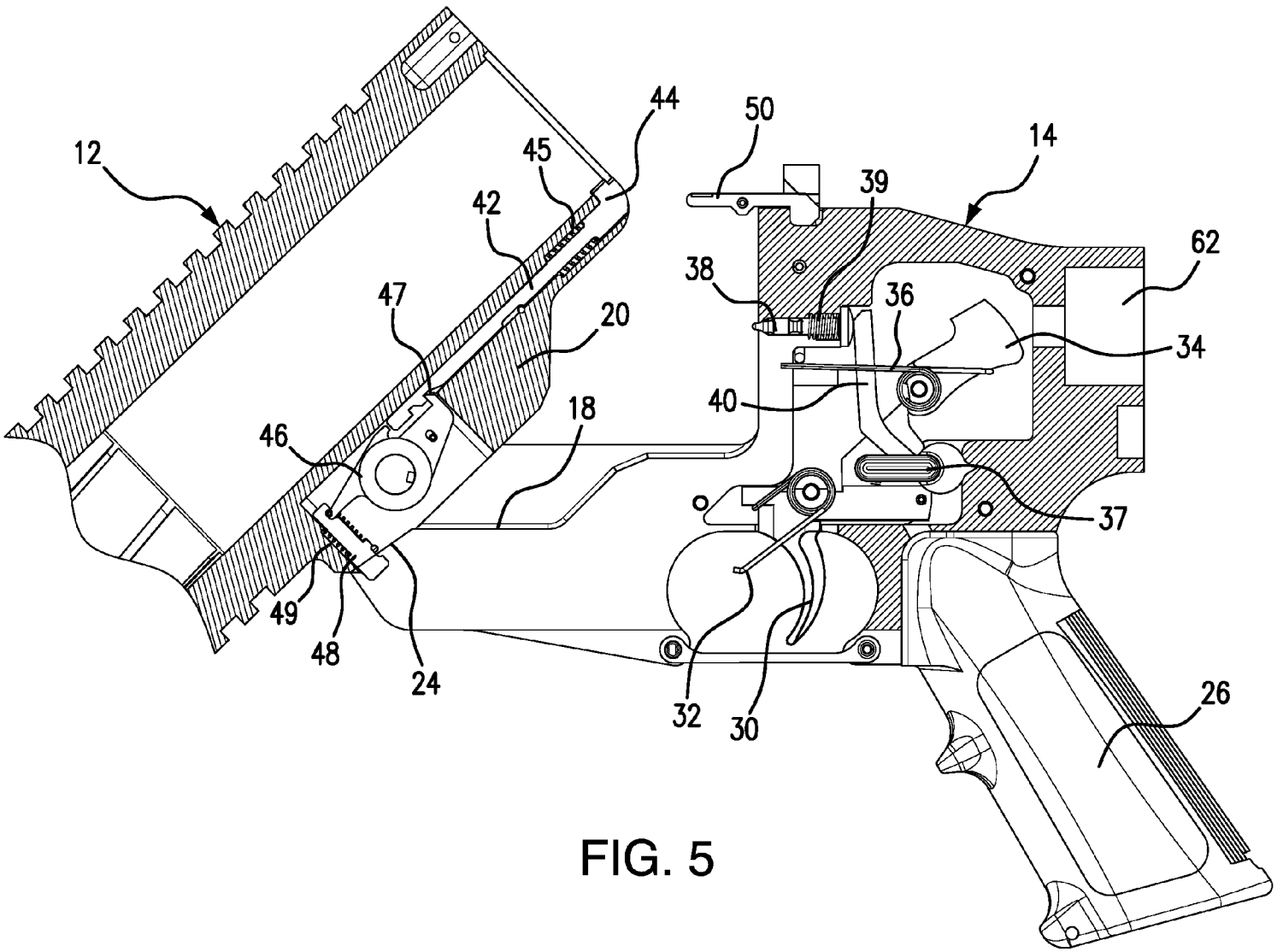
FIG. 5 is an isolated view, in partial cross section showing a double action trigger assembly in the receiver assembly and an automatic ejection assembly in the barrel assembly, with the barrel assembly opened to the 45 degree stop position relative to the receiver assembly.
Figure 6:
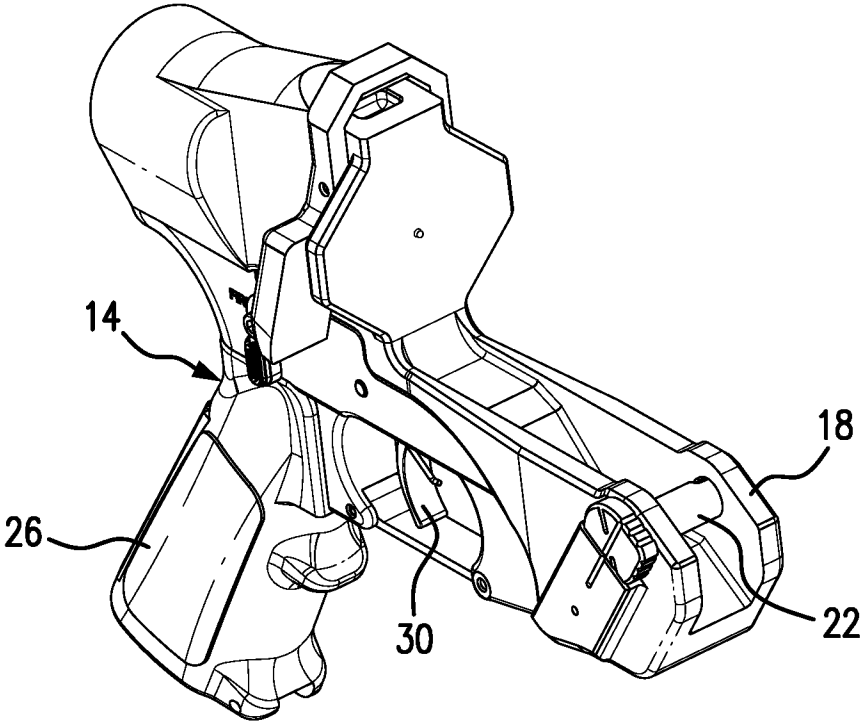
FIG. 6 is a front, side perspective view of the receiver assembly showing a dovetail arrangement on the receiver assembly for mounting the barrel assembly thereto and a takedown pin extended through the dovetail arrangement for securing the barrel assembly in the closed and ready to fire position.

The launcher 10 further includes a hidden double action trigger group which prevents the hammer spur from hanging up on operations. The double action trigger group includes a trigger 30 with a trigger spring 32. A hammer 34 is hidden inside of the receiver assembly 14 so that the launcher 12 can only be fired in a double action mode. The trigger 30 is an AR trigger that has been designed to function in double action mode. A transfer bar 40 provides an internal safety system so that if the launcher were to be dropped or subject to a sudden jolt or impact, it would not accidentally fire. Specifically, the trigger 30 needs to be pulled, moving the transfer bar 40 into position to transfer the energy from the hammer 34 through the transfer bar 40 and to the firing pin 38. The launcher 12 is provided with an external fire select switch 37 on the outside of the receiver assembly 14. The shooter can move the fire select switch 37 from safety to fire, allowing the transfer bar 40 to move into the firing position behind the firing pin 38. Referring to FIG. 4, the default position is shown wherein the trigger 30 is at rest and the hammer 34 is at rest on the frame of the receiver assembly, with the transfer bar 40 moved away from the hammer 34 and firing pin 38. The firing pin is held back by spring 39 preventing the firing pin 38 from contacting the primer of the round that would be loaded in the chamber of the barrel assembly. When moving to a cocking position, as seen in FIG. 5, the trigger is moved approximately 8 degrees from the default position and the hammer 34 is cocked back to approximately 60 degrees, with the transfer bar 40 moved into position directly behind the firing pin 38. A second pulling movement on the trigger moves the hammer 34 back even further until the hammer 34 is tripped, causing the hammer to move rapidly forward and into contact with the transfer bar 40, forcing the firing pin 38 rapidly forward against the force of the spring 39 and into the primer of a round loaded in the chamber of the barrel assembly 12. Once the trigger is released, the entire double action trigger group goes back to the default position as shown in FIG. 4.

After firing a round, the barrel assembly is opened, by operation of the receiver latch 50, as shown in FIGS. 4 and 5. When the barrel assembly reaches the fully open position, at approximately 45 degrees, an ejector actuator pin 48 comes into contact with the stop structure 24 on the dovetail arrangement 18 and is urged upwardly against the force of a spring 49 to rotate a cam 46 releasing a tooth of the cam from a notch 47 in an ejector rod 42. When the tooth of the cam is released from the notch 47, the ejector rod 42 is urged outwardly from the proximal end of the barrel by the spring 45. An ejector member 44 which engages a back of the casing of the round loaded in the chamber is forced outwardly to discharge the casing from the proximal end of the barrel assembly, thereby allowing for convenient and fast reloading of a new round of munition within the chamber of the barrel assembly.

Figure 2:
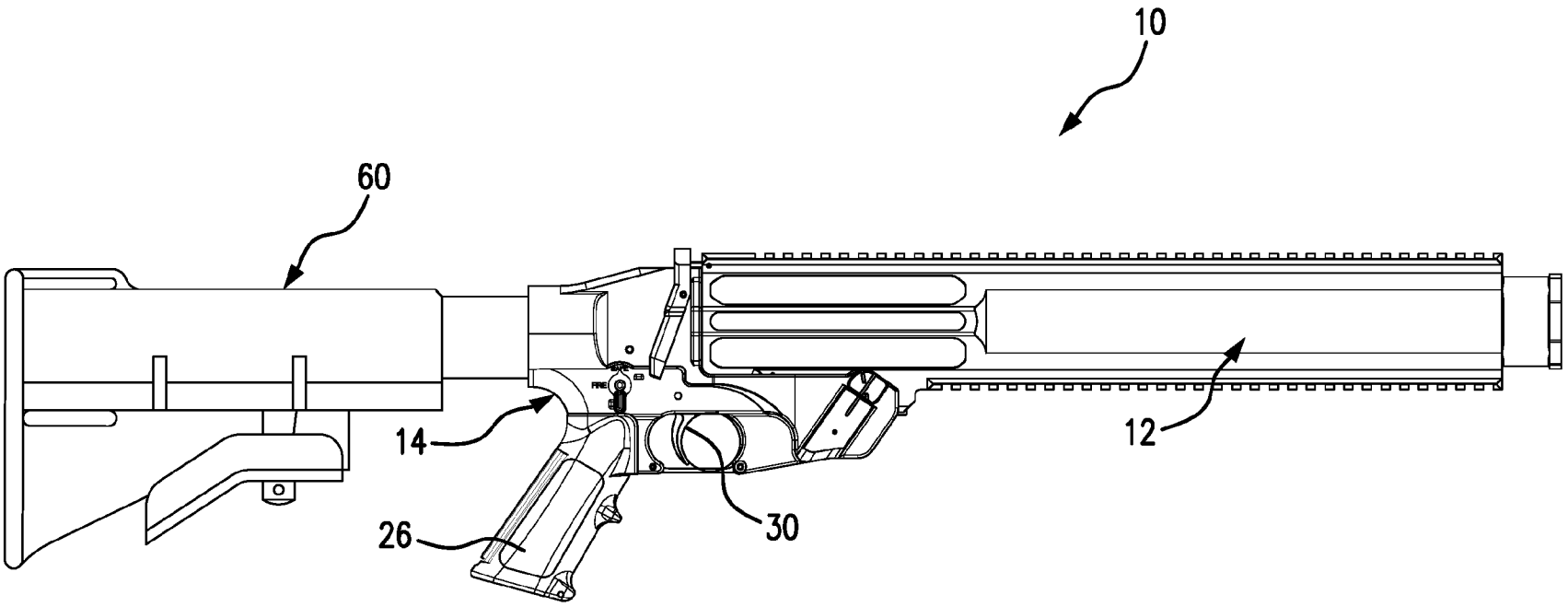
FIG. 2 is a side elevational view of the single 40 mm projectile launcher.
Figure 3:
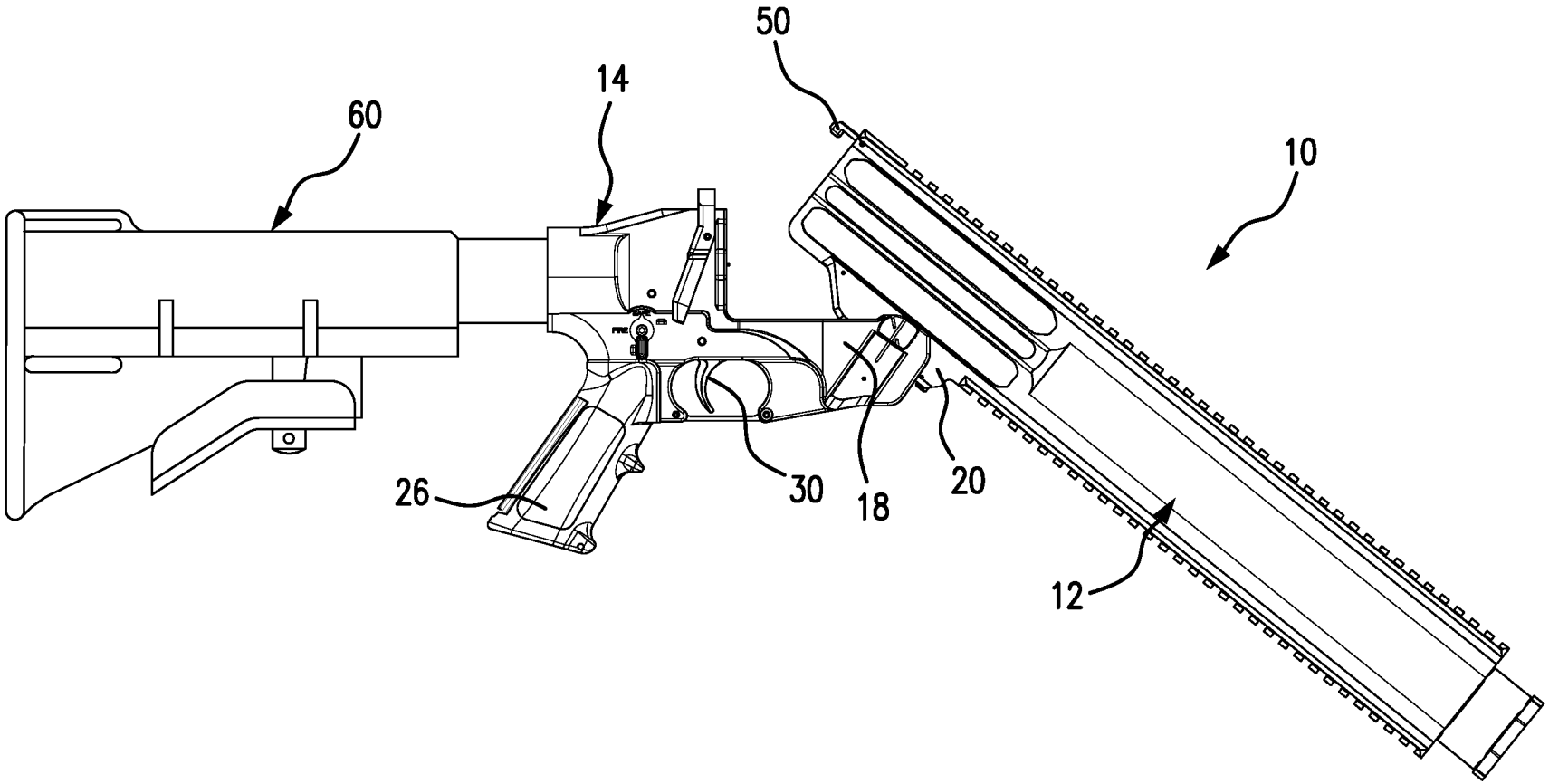
FIG. 3 is a side view of the single 40 mm projectile launcher shown with the barrel assembly hinged open to approximately 45 degrees for loading a 40 mm round in the chamber of the barrel assembly.

The launcher further includes a grip 26 and a receiver socket 62 for attachment of a buttstock 60, as seen in FIGS. 1-3. The launcher also includes a waterproof nitrate coating for rust proofing. An arrangement of four built-in picatinny rails on the barrel allow for attachment of accessories such as lights, fore grips, slings, etc. In a preferred embodiment, the barrel length is 12.9 inches.

While the present invention has been shown and described in accordance with a preferred and practical embodiment, it is recognized that departures from the instant disclosure are fully contemplated within the spirit and scope of the invention which is not to be limited except as defined in the following claims.

What is claimed is:

1. A launcher device for launching 40 mm projectiles comprising:

a receiver assembly with a dovetail arrangement thereon;

a barrel assembly structured for pivotal attachment to the dovetail arrangement on the receiver assembly and the barrel assembly being movable between a closed position relative to the receiver assembly, defining a firing position, and an open position relative to the receiver assembly, defining a reload position, and the barrel assembly having a chamber for receiving a 40 mm projectile round therein for firing from the launcher device;

a receiver latch for securing the barrel assembly closed in the firing position, and the receiver latch being operable to release the barrel assembly to allow movement of the barrel assembly to the open, reload position;

a stop structure on the receiver assembly for limiting pivotal movement of the barrel assembly relative to the receiver assembly to the open, reload position, wherein the barrel assembly is at an angle of less than 70 degrees relative to the receiver assembly;

a double action trigger assembly in the receiver assembly including a trigger, a hammer, a firing pin and a transfer bar, and the double action trigger assembly requiring the trigger to be pulled to a first position to move the transfer bar to a firing position behind the firing pin and the hammer back to a cocked position, and then pulled to a second position to cause the hammer to be released from a cocked position and to strike the transfer bar and transmit a force to the firing pin for firing the round of the 40 mm projectile from the launcher;

a spring loaded takedown pin for pivotal attachment of the barrel assembly to the dovetail arrangement on the receiver assembly, and the takedown pin being structured and disposed to be removed from the dovetail arrangement on the receiver assembly to allow for separation of the barrel assembly from the receiver assembly; and an ejector assembly on the barrel assembly for ejecting a spent casing of a fired round of the 40 mm projectile when the barrel assembly is moved from the closed position to the open, reload position, the ejector assembly including:

a rotatable cam;

an ejector rod structured to releasably engage with the rotatable cam;

an ejector actuator pin engaged with the cam;

a first spring coupled to the ejector actuator pin and exerting a force on the ejector actuator pin to hold the cam in engagement with the ejector rod;

the ejector actuator pin being structured and disposed to move against the force of the first spring and rotate the cam, causing the cam to release from the ejector rod, when the barrel assembly reaches the open reload position and the ejector actuator pin contacts the stop structure on the dovetail arrangement;

a second spring for urging the ejector rod outwardly from a proximal end of the barrel upon release of the ejector rod from the cam; and an ejector member for engaging a back of the spent casing, and the ejector member being forced outwardly by the ejector rod to discharge the casing from the proximal end of the barrel assembly.

2. The launcher device as recited in claim 1 wherein the stop structure is structured for limiting pivotal movement of the barrel assembly to 45 degrees at the open, reload position.

3. The launcher device as recited in claim 2 wherein the dovetail arrangement on the receiver assembly is structured and disposed for discouraging left and right swaying movement of the barrel assembly relative to the receiver assembly.

* * * * *